United States Patent [19]

Yanoma et al.

[11] Patent Number: 4,739,180

[45] Date of Patent: Apr. 19, 1988

[54] METHOD AND APPARATUS FOR GENERATING ELECTRIC ENERGY USING HYDROGEN STORAGE ALLOY

[75] Inventors: Akira Yanoma; Junichi Sakaguchi, both of Yokohama, Japan

[73] Assignee: Chioyda Chemical Engineering & Construction Co., Ltd., Yokohama, Japan

[21] Appl. No.: 26,905

[22] Filed: Mar. 17, 1987

[30] Foreign Application Priority Data

Dec. 23, 1986 [JP] Japan ..... 61-315614

[51] Int. Cl.[4] ..... F01K 25/00

[52] U.S. Cl. ..... 290/2; 290/52; 60/651

[58] Field of Search ..... 290/2, 52; 60/649, 650, 60/651, 655

[56] References Cited

U.S. PATENT DOCUMENTS

| | | | |
|---|---|---|---|
| 3,296,449 | 1/1967 | Plust et al. | 290/2 |
| 4,198,827 | 4/1980 | Terry et al. | 60/655 X |
| 4,281,255 | 7/1981 | Sherman | 290/2 X |
| 4,330,084 | 5/1982 | Buchner et al. | 290/2 X |
| 4,503,682 | 3/1985 | Rosenblatt | 60/651 X |
| 4,537,031 | 8/1985 | Terry et al. | 60/649 |

*Primary Examiner*—William M. Shoop, Jr.
*Assistant Examiner*—W. E. Duncanson, Jr.
*Attorney, Agent, or Firm*—Stephen F. K. Yee

[57] ABSTRACT

An electric generator operatively connected to a gas turbine is driven by driving the gas turbine with high pressure hydrogen released from a hydrogen storage alloy which is contained in a first zone and which is heated by indirect heat exchange with a heating medium while reabsorbing the hydrogen discharged from the gas turbine in a hydrogen storage alloy which is contained in a second zone and which is cooled by indirect heat exchange with a cooling medium. By switching the flows of the heating and cooling media alternately, an electric energy may be continuously obtained from the electric generator.

10 Claims, 3 Drawing Sheets

METHOD AND APPARATUS FOR GENERATING ELECTRIC ENERGY USING HYDROGEN STORAGE ALLOY

This invention relates to a method of generating electric energy using a hydrogen storage alloy and to an apparatus therefor.

Heretofore, generation of electric power by means of a gas turbine using a source of heat of middle-low temperature levels has been effected by evaporating a pressurized, condensible heat transfer medium such as water, freon gas or natural gases, introducing the resulting vapor into the gas turbine for driving same, condensing the vapor discharged from the gas turbine, and reheating the condensed liquid heat transfer medium for vaporization and for recirculation into the gas turbine. The conventional method, however, requires the use of a heat transfer medium whose boiling point is considerably lower than the temperature of a heat source because the boiling point is constant under constant pressure. Further, in order to condense the vapor of the heat transfer medium discharged from the gas turbine with high efficiency, the temperature at which the heat transfer medium is condensed is required to be considerably higher than the temperature of a cooling source. For the above reasons, it is necessary that the difference in temperature between the heating and cooling sources is considerably large. Thus, it is actually difficult to drive a gas turbine in the above-described manner with practically acceptable efficiency and cost when using a heat source of middle-low levels (50°-150° C.) and a cooling source of about 10°-30° C.

It is the prime object of the present invention to provide an effective method of generating electric energy using a heat source of a middle-low temperature and an apparatus suitable for carrying out such a method.

In accordance with one aspect of the present invention, there is provided a method of generating an electric energy, comprising the steps of:

providing a gas turbine, an electric generator operatively connected to said gas turbine and capable of generating an electric energy when said gas turbine is driven, and a plurality of zones each containing a hydrogen storage alloy capable of absorbing hydrogen upon being cooled and of releasing the absorbed hydrogen upon being heated;

heating the hydrogen storage alloy in at least one of said plurality of zones while cooling the hydrogen storage alloy in at least one of the other zones, so that the heated hydrogen storage alloy releases hydrogen;

introducing said released hydrogen into said gas turbine to drive same; and feeding the hydrogen used for driving said gas turbine to said at least one of the other zones containing the hydrogen storage alloy being cooled to allow the released hydrogen to be reabsorbed thereby.

In another aspect, the present invention provides a method of generating an electric energy, comprising the steps of:

providing a gas turbine, an electric generator operatively connected to said gas turbine and capable of generating an electric energy when said gas turbine is driven, and first and second hydrogen absorbing and desorbing systems each including a plurality of heat exchange zones each containing a hydrogen storage alloy capable of absorbing hydrogen upon being cooled and of releasing the absorbed hydrogen upon being heated;

supplying a heating medium to said first system for heating the hydrogen storage alloy in at least one of said plurality of heat exchange zones of said first system by indirect heat exchange therewith while supplying a cooling medium to said first system for cooling the hydrogen storage alloy in at least one of the other heat exchange zones of said first system by indirect heat exchange therewith, so that the heated hydrogen storage alloy in said first system releases hydrogen;

introducing said released hydrogen in said first system into said gas turbine to drive same;

discharging from said first system the heating medium which has been used for said heating of the hydrogen storage alloy in said first system and introducing same into said second system for heating the hydrogen storage alloy in at least one of said plurality of heat exchange zones of said second system by indirect heat exchange therewith while supplying the cooling medium to said second system for cooling the hydrogen storage alloy in at least one of the heat exchange other zones of said second system by indirect heat exchange therewith, so that the heated hydrogen storage alloy in said second system releases hydrogen;

introducing said released hydrogen in said second system into said gas turbine at an intermediate position downstream from the port through which said released hydrogen from said first system is introduced into said gas turbine; and feeding the hydrogen used for driving said gas turbine to said at least one of the other zones of said first and second systems containing the hydrogen storage alloy being cooled to allow the released hydrogen to be reabsorbed thereby.

In a further aspect the present invention provides an apparatus for generating an electric energy, comprising:

a gas turbine;

an electric generator operatively connected to said gas turbine and capable of generating an electric energy when said gas turbine is driven;

a plurality of heat exchange zones each containing a hydrogen storage alloy capable of absorbing hydrogen upon being cooled and of releasing the absorbed hydrogen upon being heated and each adapted for heating or cooling the hydrogen storage alloy contained therein by indirect heat exchange with a heating or a cooling medium supplied thereto;

heating medium supply conduit means connected to said plurality of heat exchange zones for supplying the heating medium to respective heat exchange zones;

cooling medium supply conduit means connected to said plurality of heat exchange zones for supplying the cooling medium to respective heat exchange zones;

first valve means provided in said heating medium and cooling medium supply conduit means and operable so that each of said plurality of heat exchange zones is supplied with the heating and cooling media alternately and that at least one of said plurality of heat exchange zones is supplied with the heating medium with at least one of the other zones being supplied with the cooling medium, whereby hydrogen is released from the hydrogen storage alloy heated by indirect heat exchange with the heating medium;

hydrogen feed pipes extending between said plurality of heat exchange zones and said gas turbine for introducing the released hydrogen from respective heat exchange zones into said gas turbine;

hydrogen discharge pipes extending between said plurality of heat exchange zones and said gas turbine for feeding the hydrogen from said gas turbine to respective heat exchange zones;

second valve means provided in said hydrogen feed pipes and operable so that the passage of hydrogen through the hydrogen feed pipes is prevented except those leading from said at least one of said plurality of heat exchangers; and third valve means provided in said hydrogen discharge pipes and operable so that the passage of hydrogen through the hydrogen discharge pipes is prevented except those leading to said at least one of the other heat exchange zones, whereby the hydrogen released from said at least one of said plurality of heat exchange zones is introduced into said gas turbine to drive same and is then reabsorbed by the hydrogen storage alloy in said at least one of the other heat exchange zones cooled by indirect heat exchange with the cooling medium.

In a still further aspect, the present invention provides an apparatus for generating an electric energy, comprising:

a gas turbine having gas inlet and gas outlet ports and capable of being driven by hydrogen gas flowing from said inlet to outlet ports;

an electric generator operatively connected to said gas turbine and capable of operating, when said gas turbine is driven, to generate an electric energy;

first through sixth heat exchange zones each containing a hydrogen storage alloy capable of absorbing hydrogen upon being cooled and of releasing the absorbed hydrogen upon being heated and each adapted to heat or cool the hydrogen storage alloy containined therein by indirect heat exchange with a heating or cooling medium supplied thereto;

connecting conduit means connecting said first through sixth heat exchange zones in loop so that the heating or cooling medium can recirculate successively through said first to sixth heat exchange zones in that order;

a source of the heating medium;

a source of the cooling medium;

first through sixth, heating medium feed conduits, extending between said first through sixth heat exchange zones and said source of the heating medium, respectively, for introducing therethrough the heating medium to respective heat exchange zones;

first through sixth, cooling medium feed conduits, extending between said first through sixth heat exchange zones and said source of the cooling medium, respectively, for introducing therethrough the cooling medium to respective heat exchange zones;

first valve means provided in said heating medium and cooling medium feed conduits and operable so that the heating medium from said source thereof is fed to selected one of said first through sixth heat exchange zones and the cooling medium from said source thereof is fed to the next but two heat exchange zone located downstream of said selected heat exchange zone;

second valve means provided in said connecting conduit means and operable so that the heating medium introduced into said selected heat exchange zone is passed successively to two succeeding heat exchange zones located downstream from said selected heat exchange zone and the cooling medium introduced into said next but two heat exchange zone is passed successively to two succeeding heat exchange zones located downstream from said next but two heat exchange zone;

first through sixth hydrogen feed pipes, extending between said first through sixth heat exchange zones and said gas inlet, respectively, for introducing the released hydrogen from respective heat exchange zones into said gas turbine;

first through sixth hydrogen discharge pipes, extending between said first through sixth heat exchange zones and said gas outlet, respectively, for feeding the hydrogen from said gas turbine to respective heat exchange zones;

third valve means provided in said first through sixth hydrogen feed pipes and operable so that the passage of hydrogen through said first through sixth hydrogen feed pipes is prevented except those leading from said selected heat exchange zone and its adjacent downstream heat exchange zone; and fourth valve means provided in said first through sixth hydrogen discharge pipes and operable so that the passage of hydrogen through said first through sixth hydrogen discharge pipes is prevented except those leading to said next but two heat exchange zone and its adjacent downstream heat exchange zone.

The present invention will now be described in detail below with reference to the accompanying drawings, in which.

Figure 1:
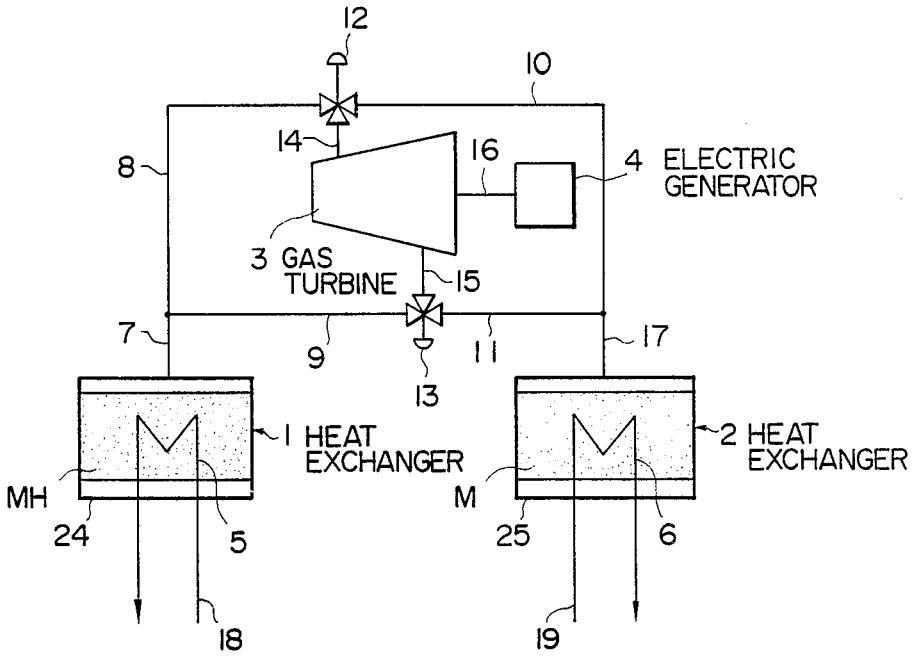
FIG. 1 is a flow chart of an apparatus for the generation of electric energy according to the present invention.

Referring first to FIG. 1, the reference numeral 1 denotes a first heat exchange zone, generally a heat exchanger, accomodating a bed of a hydrogen storage alloy MH which has absorbed hydrogen, 2 denotes a second heat exchange zone, similar to the first heat exchange zone, accomodating a bed of a hydrogen storage alloy M which is generally the same as the alloy in the first heat exchange zone 1 and which has released hydrogen. The first and second heat exchangers 1 and 2 are generally composed of first and second closed containers 24 and 25, respectively, in which first and second heat transfer members, such as heat transfer pipes 5 and 6, respectively, are disposed for heating or cooling the hydrogen storage alloy contained in the first and second containers 24 and 25 by indirect heat exchange with heat transfer media flowing therethrough. The heat transfer media are introduced in the first and second heat transfer pipes 5 and 6 through feed conduits 18 and 19, respectively.

Designated as 3 is a gas turbine to which an electric generator 4 is connected through a transmission shaft 16 so that the generator 4 operates and generates an electric energy or power upon driving of the gas turbine 3. The gas turbine 3 has a hydrogen inlet conduit 14 which is connected, via three-way valve 12, both to the first heat exchanger 1 through pipes 8 and 7 and to the second heat exchanger 2 through pipes 10 and 17. The gas turbine 3 also has a hydrogen outlet conduit 15 which is connected, via three-way valve 13, both to the first heat exchanger 1 through pipes 9 and 7 and to the second heat exchanger 2 through pipes 11 and 17.

The apparatus thus constructed operates as follows. The hydrogen storage alloy MH in the first heat exchanger 1 is heated, while maintaining the three-way valves 12 and 13 in closed state, by introducing a heating medium through the line 18 into the first heat transfer pipe 5, so that the hydrogen absorbed in the alloy MH is released therefrom and the first container 24 and the pipes 7, 8 and 9 are filled with hydrogen at a tempeature of $T_1$ and a pressure of $P_1$. At the same time, the hydrogen storage alloy M is cooled indirectly be introducing a cooling medium into the second heat transfer pipe 6 through the line 19 so that the inside of the second container 25 has a temperature $T_2$ and a pressure $P_2$.

The three-way valves 12 and 13 are then actuated to selectively communicate the inlet conduit 14 with the pipe 8 and to selectively communicate the outlet conduit 15 with the pipe 11. As a result, the high pressure hydrogen is introduced into the gas turbine 3 through lines 7, 8 and 14 and, after driving the gas turbine and the electric generator 4, passed through lines 15, 11 and 17 to the second container 25 of the second heat exchanger 2 where the hydrogen is reabsorbed by the alloy M. In this case, there are maintained relationships of $P_1 > P_2$ and $T_1 > T_2$ while the alloy MH in the first heat exchanger 1 releases the absorbed hydrogen and the alloy M absorbes the released hydrogen. Therefore, the gas turbine 3 continues driving until the system arrives at an equilibrium.

When the desorption of hydrogen from the alloy in the first heat exchanger 1 ceases, the valves 12 and 13 are closed. Then, the heating medium is supplied to the second heat transfer pipe 6 while the cooling medium is introduced into the first heat transfer pipe 5 so that the hydrogen absorbed, in the previous step, in the alloy in the second heat exchanger 2 is desorbed therefrom and fills the lines 10, 11 and 17 and the container 25 at a temperature of $T_2'$ and a pressure of $P_2'$. The valves 12 and 13 are then opened to communicate the line 10 with the line 14 and the line 9 with the line 15. This results in the introduction of the hydrogen at $T_2'$ and $P_2'$ into the gas turbine 3, thereby driving the electric generator 4 operatively connected to the gas turbine 3. The hydrogen is then fed, through the lines 15, 9 and 7, to the first heat exchanger 1 and is absorbed by the alloy in the first heat exchanger 1 at a temperature of $T_1'$ and a pressure of $P_1'$. Since $P_1' < P_2'$ and $T_1' < T_2'$, the gas turbine 3 is driven with the high pressure hydrogen serving as a working gas.

The operation as described above are repeated to continuously obtain an electric energy from the generator 4. In this case, since the efficiency in the turbine 3 depends upon the difference in temperature in the incoming hydrogen and the exausted hydrogen, it is effective to provide a heater (not shown) in the hydrogen inlet conduit 14 in improving the operation efficiency of the gas turbine 3.

Figure 2:
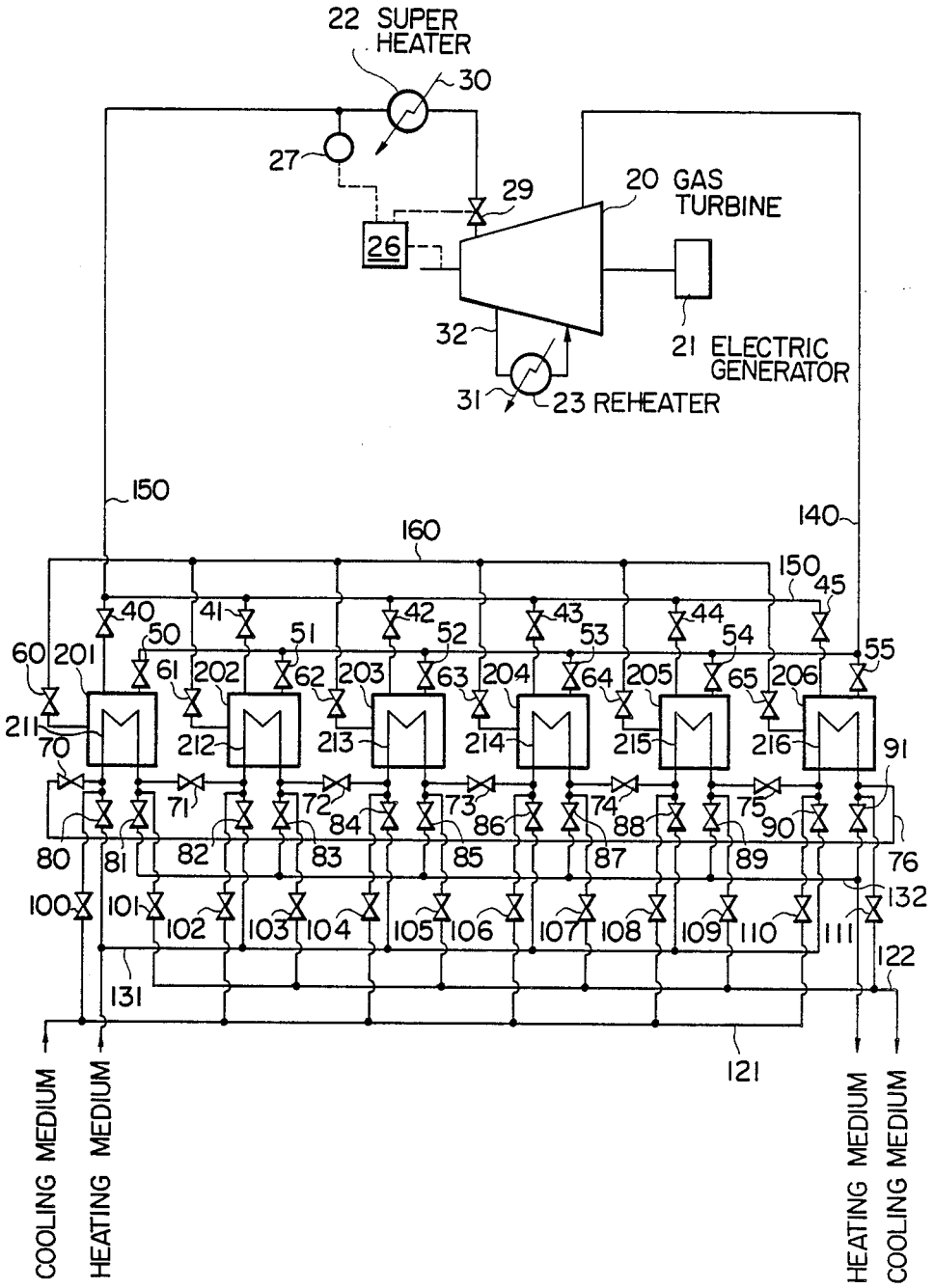
FIG. 2 is a flow chart of another preferred embodiment of the apparatus according to the present invention.

FIG. 2 depicts one preferred embodiment of the apparatus for the generation of electric energy according to the present invention which is suited for continuously obtaining leveled electric power. The apparatus includes a combination of a gas turbine 20 and an electric generator 21 similar to that described previously with reference to FIG. 1. In the embodiment shown, the gas turbine 20 is driven with high pressure hydrogen supplied from a hydrogen releasing and absorbing system as described below.

The hydrogen desorbing and absorbing system includes six, first through sixth heat exchange zones 201–206, generally heat exchangers, within each of which is provided a bed of hydrogen storage alloy, generally of the same kind. The first through sixth heat exchangers 201–206 are connected to an inlet port of the gas turbine 20 by hydrogen feed pipes 150 via valve means, generally open-close valves 40–45, respectively, and to an outlet port of the gas turbine 20 by hydrogen discharge pipes 140 via valve means, generally open-close valves 50–55, respectively.

The first through sixth heat exchangers 201–206 have first through sixth heat transfer members such as heat transfer pipes 211–216, respectively, for cooling or heating the hydrogen storage alloy contained therein. The first and sixth heat transfer pipes 211–216 are connected to a source of a heating medium via heating medium feed conduits 131 and valve means, generally open-close valves 80, 82, 84, 86, 88 and 90, respectively, and also to a source of a cooling medium via cooling medium feed conduits 121 and valve means, generally open-close valves 100, 102, 104, 106, 108 and 110, respectively. The first through sixth heat transfer pipes 211–216 are connected to heating medium discharge lines 132 via valve means, generally open-close valves 81, 83, 85, 87, 89 and 91, respectively, and to cooling medium discharge lines 122 via valve means, generally open-close valves 101, 103, 105, 107, 109 and 111.

Furthermore, the first through sixth heat transfer pipes 211–216 are connected to form a loop by connecting conduits 76 provided with valve means, generally open-close valves 70–75.

In the thus constructed apparatus, different operations, i.e. preheating, primary hydrogen desorption, secondary hydrogen desorption, pre-cooling, primary hydrogen absorption and secondary hydrogen absorption, are simultaneously performed in the first through sixth heat exchangers 201–206, with each heat exchanger performing successively and cyclically these operations in the manner as follows.

In an instance where preheating is run in the third heat exchanger 203, the primary hydrogen desorption is run in the second heat exchanger 202, the secondary hydrogen desorption in the first heat exchanger 201, the pre-cooling in the sixth heat exchanger 206, the primary hydrogen absorption in the fifth heat exchanger 205 and the secondary hydrogen absorption in the fourth heat exchanger 204, the open-close valves 40–45, 50–55, 70–75, 80–91 and 100–111 are set in the following conditions:

Opened: 80, 71, 72, 85, 106, 74, 75, 111, 40, 41, 53 and 54

Closed: All valves other than the above

Thus, the heating medium is introduced into the first heat transfer pipe 211 and is passed successively through the second and third heat transfer pipes 212 and 213 to heat the respective hydrogen storage alloys contained in respective heat exchangers 201–203. The temperature of the heating medium becomes gradually lowered as it is passed in the downstream side heat exchangers. Thereafter, the medium is exhaused through the discharge conduit 132. On the other hand, the cooling medium is introduced into the fourth heat transfer pipe 214 and is then fed to the fifth and sixth heat transfer pipes 215 and 216 to cool the respective alloys in respective heat exchangers 214–216. The temperature of the cooling medium becomes gradually increased as it is passed in the down stream side heat exchangers. The cooling medium discharged from the sixth heat transfer piper 216 is exhausted through the line 122.

In the above conditions, hydrogen is released from the hydrogen storage alloys in the first and second heat exchangers 201 and 202 and is fed though valves 40 and 41 and feed pipes 150 to the gas turbine 20. The hydrogen which has been used for the driving of the gas turbine is then fed through the discharge pipes 140 and the valves 53 and 54 to the fourth and fifth heat exchangers 214 and 215 where it is reabsorbed by respective hydrogen storage alloy cooled by indirect heat exchange with the cooling medium flowing in the heat transfer pipes 214 and 215. In the third and sixth heat exchangers, preheating and precooling are effected, respectively.

When the release of hydrogen in the hydrogen storage alloy in the first heat exchanger 201 is substantially finished, the valves are shifted as follows:

Opened: 82, 72, 73, 87, 108, 75, 70, 101, 41, 42, 54 and 55

Closed: all valves other than the above

Thus, the heating medium is first supplied to the second heat transfer pipe 212 in the second heat exchanger 202, which has been subjected to the primary hydrogen desorbing conditions, so that the alloy in the second heat exchanger 202 is heated to a higher temperature than that in the previous primary desorbing step. As a result, the hydrogen which remains unreleased in the primary hydrogen desorbing step is released from the alloy in the second heat exchanger 202. The heating medium is then passed to the third heat transfer pipe 213 to heat the alloy in the third heat exchanger 203, which has been preheated in the preheating step, so that the hydrogen is released from the preheated alloy (primary desorption). The released hydrogen from the second and third heat exchangers 202 and 203 is supplied to the gas turbine 20 through the opened valves 41 and 42 and lines 150.

On the other hand, the cooling medium is first supplied to the fifth heat transfer pipe 215, which has been subjected to the primary hydrogen absorbing conditions, so that the alloy in the fifth heat exchanger 205 is cooled to a lower temperature than that in the previous primary absorbing step. As a result, the alloy in the fifth heat exchanger 205 further absorbs hydrogen supplied from the gas turbine 20 through the line 140 and the opened valve 54. The cooling medium is then passed to the sixth heat transfer pipe 216 to cool the alloy in the sixth heat exchanger 206, which has been pre-cooled in the pre-cooling step, so that the hydrogen supplied from the gas tubine 20 through the opened valve 55 is absorbed by the precooled alloy in the sixth heat exchanger 206 (primary absorbing step).

The heating medium in the third heat transfer pipe 213 is passed to the fourth heat transfer pipe 214 through the opened valve 73 to preheat the alloy in the fourth heat exchanger 204 which has absorbed hydrogen in the previous secondary hydrogen absorbing step. The cooling medium in the sixth heat transfer pipe 216 is passed to the first heat transfer pipe 211 through the opened valve 70 to pre-cool the alloy in the first heat exchanger 201 which has desorbed hydrogen in the previous secondary hydrogen desorbing step.

When the secondary desorption of hydrogen from the alloy in the second heat exchanger 202 is finished, the valves are operated to effect the secondary hydrogen desorption in the next third heat exchanger 203, the primary desorption in the fourth heat exchanger 204, the preheating in the fifth heat exchanger 205, the secondary hydrogen absorption in the sixth heat exchanger 206, the primary absorption in the first heat exchanger 201 and the pre-cooling in the second heat exchanger 202. By operating the valves 40–45, 50–55, 70–75, 80–91 and 100–111 in order in the above manner, the gas turbine 20 is driven continuously since hydrogen is continuously desorbed from at least one of the hydrogen storage alloys in the first through sixth heat exchangers 201–206 and is continuously absorbed in at least one of the heat exchangers 201–206 throughout the process inclusive of during the valve opening and closing operations. Therefore, the above-described apparatus of the present invention can continuously generate a leveled electric power.

Preferably, the first through sixth heat exchangers 201–206 are connected in parallel with each other by means of connecting pipes 160 through valves 60–65 as shown in FIG. 2. The valves 60–65 are operated so as to intercommunicate the heat exchanger in which the secondary hydrogen desorption was finished and which has disconnected from the gas turbine 20 and the heat exchanger in which the secondary hydrogen absorption was finished and which has disconnected from the gas turbine 20. By this, the hydrogen pressures in the two heat exchangers are equalized. As a consequence, the hydrogen storage alloy which finished its secondary hydrogen desorption can further release the absorbed hydrogen while the alloy which finished its secondary hydrogen absoption can further absorb the released hydrogen, improving the hydrogen desorbing and absorbing efficiency of the alloy. The valve operations for the above hydrogen pressure equalizing procedure will be described more particularly hereinbelow.

Suppose that the secondary hydrogen desorption in the first heat exchanger 201 and the secondary hydrogen absorption in the fourth heat exchanger 204 have just finished. Then, the valves 40 and 53 are closed so that the first and fourth heat exchangers are disconnected from the gas turbine 20. Thereafter, the valves 60 and 63 are opened to selectively communicate the first and fourth heat exchangers 201 and 204 with each other. This causes the high pressure hydrogen remaining in the first heat exchanger 201 to flow into the fourth heat exchanger 204 containing low pressure hydrogen, thereby equalizing the pressure in the first and fourth heat exchangers 201 and 204 to a middle hydrogen pressure. Under this condition, the hydrogen storage alloy in the first heat exchanger 201 further releases hydrogen of the middle pressure while the alloy in the fourth heat exchanger 204 further absorbs the desorbed hydrogen of the middle pressure. Then, the valves 60 and 53 are closed to separate the heat exchangers 201 and 204 from each other, and the valves 80, 71, 106 and 74 are closed with the simultaneous opening of the valves 70, 101, 73 and 87 to effect pre-cooling in the first heat exchanger 201 and preheating in the fourth heat exchanger 204.

By carrying out the above pressure-equalizing operation before the preheating and pre-cooling, the amount of hydrogen absorbed by the alloy in the first heat exchanger becomes smaller while the amount of hydrogen absorbed by the alloy in the fourth heat exchanger becomes greater. Therefore, the hydrogen available for working the gas turbine 20 per unit weight of the alloy is increased, improving the efficiency of the apparatus.

In FIG. 2, designated as 22 is a super heater for heating the hydrogen gas with a heating medium flowing through a line 30 and 23 is a reheater for heating the hydrogen gas, diverted from the gas turbine 20 through a line 32, with a heating medium flowing through a line 31. Both the superheater 22 and the reheater 23 can serve to improve the electric power generation efficiency of the apparatus. The gas turbine 20 is preferably a multiple stage expansion turbine. The reference numeral 27 designates a pressure detecting controller, 26 a speed and pressure governing mechanism and 29 a speed and pressure governing valve.

In the embodiment illustrated in FIG. 2, each of the first through sixth heat exchange zones 201–206 is constituted from a single heat exchanger. However, it is of course possible to construct each heat exchange zone or each desired heat exchange zone from two or more heat exchangers whose heating or cooling medium inlets and outlets are connected in series and whose hydrogen inlets and outlets are connected in parallel. Thus, for the purpose of the present specification, the term "a heat exchange zone" is intended to refer not only to a single heat exchanger but also to two or more heat exchangers in which a similar operation is performed. For example, the number of the containers in the apparatus shown in FIG. 2 can be increased to 10, three of them being used for primary cooling and another three for primary hydrogen release.

Any known hydrogen storage alloy may be suitably used for the purpose of the present invention. Representative alloys to be used for the present invention may be selected appropriately in consideration of, for example, the temperature of a source of the heating medium to be utilized for heating the alloys. The same hydrogen storage alloy is generally used for the accommodation in the first to sixth heat exchange zones 201–206, though different kinds of hydrogen storage alloys may be used if desired.

Generally, the difference in temperature of the heating medium between the inlet and outlet of the apparatus according to the present invention is less than 50° C. In an instance where it is desired to further lower the temperature of the heating medium exhausted from the apparatus, this can be suitably accomplished by using an additional hydrogen absorbing and desorbing system where the waste heating medium is utilized for hydrogen desorption.

Figure 3:
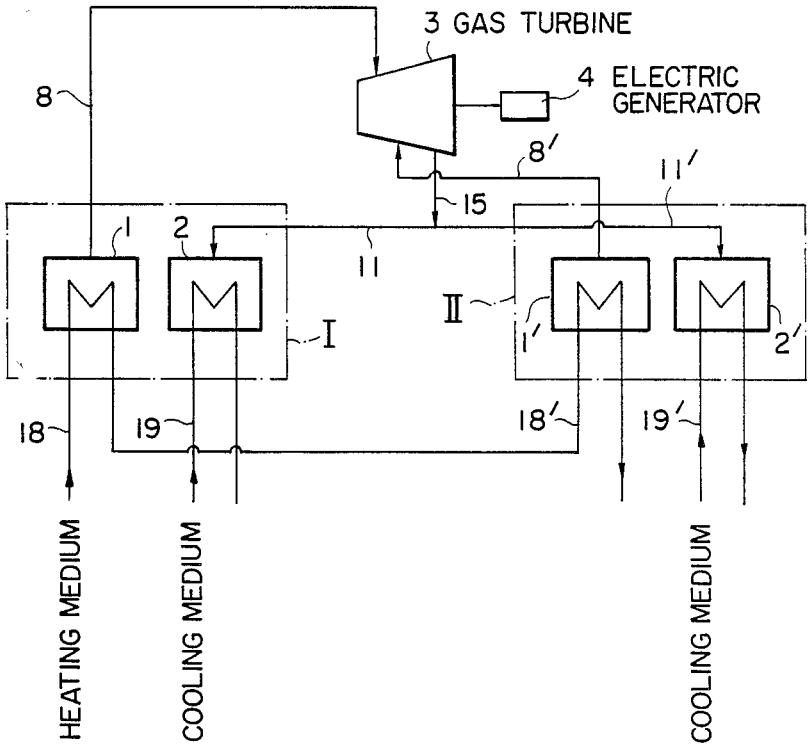
FIG. 3 is a flow chart of a further preferred embodiment of the apparatus according to the present invention.

One such example is illustrated in FIG. 3 in which two, first and second sets of apparatuses I and II as shown in FIG. 1 are used. In FIG. 3 valves are omitted from the illustration for the convenience of explanation and similar component parts are designated by the same reference numerals. A heating medium having a temperature of, for example, 120° C. is first fed through a line 18 to a heat exchange zone 1 of the first system I for heating a hydrogen storage alloy contained therein and, thereafter, discharged from the heat exchange zone 1. The discharged heating medium having a temperature of, for example 80° C. is then introduced into a heat exchange zone 1′ of the second system II for heating a hydrogen storage alloy contained therein. The hydrogen generated in the first system I is introduced through a line 8 into a gas turbine 3 for driving an electric generator 4 while the hydrogen from the second system II, which has a lower pressure than that from the first system I, is introduced through a line 8′ into an intermediate stage of the turbine 3, i.e. at a location downstream from the inlet connected to the line 8. The hydrogen is then discharged from the turbine 3 through a line 15 and is reabsorbed by the metals in heat exchange zones 2 and 2′ of the first and second systems I and II cooled by a cooling medium supplied through lines 19 and 19′, respectively.

Practically, each of the hydrogen absorbing and desorbing systems I and II of FIG. 3 may be formed of six or more heat exchangers in the similar manner as shown in FIG. 2. The hydrogen obtained in the system II is desirably heated before introduction into the gas turbine 3. When the gas turbine 3 is provided with a reheater 23 such as shown in Fig. 2, the hydrogen from the system II is preferably fed to the reheater 23.

In accordance with the present invention, electric energy may be efficiently generated using a source of heat of low levels that could not be used heretofore for electric generation. Unlike conventional techniques, no pump is required for pressure elevation and neither condenser for gases discharged from a turbine nor circulating devices for condensed gases are required, thereby rendering the electric energy generation system simple and economical. The present invention has the great industrial significance because electric energy can be advantageously generated using geothermal heat or exhaust heat of low levels produced by chemical plants or other manufacturing plants.

EXAMPLE

The apparatus as illustrated in FIG. 2 was operated with a source of a low temperature heat. The main operation conditions were as follows:

| | |
|---|---|
| Hydrogen storage alloy: | rare earth type |
| Heat source temperature (hydrogen desorbing temperature): | 110–90° C. |
| Cooling temperature (hydrogen absorbing temperature): | 30–45° C. |
| High pressure hydrogen (in line 150): | 10 atm. |
| Low pressure hydrogen (in line 140): | 1 atm. |
| Superheater temperature (as hydrogen temperature): | 140° C. |
| Reheater temperature (as hydrogen temperature): | 135° C. |
| Amount of hydrogen recirculated: | 1 Kg/second |
| Electric power generated: | 2300 KW |

We claim:

1. A method of generating an electric energy, comprising the steps of:

providing a gas turbine, an electric generator operatively connected to said gas turbine and capable of generating an electric energy when said gas turbine is driven, and a plurality of zones each containing a hydrogen storage alloy capable of absorbing hydrogen upon being cooled and of releasing the absorbed hydrogen upon being heated;

heating the hydrogen storage alloy in at least one of said plurality of zones while cooling the hydrogen storage alloy in at least one of the other zones, so that the heated hydrogen storage alloy releases hydrogen;

introducing said released hydrogen into said gas turbine to drive same; and feeding the hydrogen used for driving said gas turbine to said at least one of the other zones containing the hydrogen storage alloy being cooled to allow the released hydrogen to be reabsorbed thereby 2. A method as claimed in claim 1, further comprising heating the released hydrogen to increase the temperature thereof before being introduced into said gas turbine.

3. A method as claimed in claim 1, wherein the hydrogen storage alloy in each of said plurality of zones is heated and cooled alternately to continuously drive said gas turbine.

4. A method of generating an electric energy, comprising the steps of:

providing a gas turbine, an electric generator operatively connected to said gas turbine and capable of generating an electric energy when said gas turbine is driven, and first and second hydrogen absorbing and desorbing systems each including a plurality of heat exchange zones each containing a hydrogen storage alloy capable of absorbing hydrogen upon being cooled and of releasing the absorbed hydrogen upon being heated;

supplying a heating medium to said first system for heating the hydrogen storage alloy in at least one of said plurality of heat exchange zones of said first system by indirect heat exchange therewith while supplying a cooling medium to said first system for cooling the hydrogen storage alloy in at least one of the other heat exchange zones of said first system by indirect heat exchange therewith, so that the heated hydrogen storage alloy in said first system releases hydrogen;

introducing said released hydrogen in said first system into said gas turbine to drive same;

discharging from said first system the heating medium which has been used for said heating of the hydrogen storage alloy in said first system and introducing same into said second system for heating the hydrogen storage alloy in at least one of said plurality of heat exchange zones of said second system by indirect heat exchange therewith while supplying the cooling medium to said second system for cooling the hydrogen storage alloy in at least one of the other heat exchange zones of said second system by indirect heat exchange therewith, so that the heated hydrogen storage alloy in said second system releases hydrogen;

introducing said released hydrogen in said second system into said gas turbine at an intermediate position downstream from the port through which said released hydrogen from said first system is introduced into said gas turbine; and feeding the hydrogen used for driving said gas turbine to said at least one of the other zones of said first and second systems containing the hydrogen storage alloy being cooled to allow the released hydrogen to be reabsorbed thereby.

5. A method as claimed in claim 4, further comprising heating said released hydrogen in said second system before introducing same into said intermediate portion of said gas turbine.

6. An apparatus for generating an electric energy, comprising:

a gas turbine;

an electric generator operatively connected to said gas turbine and capable of generating an electric energy when said gas turbine is driven;

a plurality of heat exchange zones each containing a hydrogen storage alloy capable of absorbing hydrogen upon being cooled and of releasing the absorbed hydrogen upon being heated and each adapted for heating or cooling the hydrogen storage alloy contained therein by indirect heat exchange with a heating or a cooling medium supplied thereto;

heating medium supply conduit means connected to said plurality of heat exchange zones for supplying the heating medium to respective heat exchange zones;

cooling medium supply conduit means connected to said plurality of heat exchange zones for supplying the cooling medium to respective heat exchange zones;

first valve means provided in said heating medium and cooling medium supply conduit means and operable so that each of said plurality of heat exchange zones is supplied with the heating and cooling media alternately and that at least one of said plurality of heat exchange zones is supplied with the heating medium with at least one of the other zones being supplied with the cooling medium, whereby hydrogen is released from the hydrogen storage alloy heated by indirect heat exchange with the heating medium;

hydrogen feed pipes extending between said plurality of heat exchange zones and said gas turbine for introducing the released hydrogen from respective heat exchange zones into said gas turbine;

hydrogen discharge pipes extending between said plurality of heat exchange zones and said gas turbine for feeding the hydrogen from said gas turbine to respective heat exchange zones;

second valve means provided in said hydrogen feed pipes and operable so that the passage of hydrogen through the hydrogen feed pipes is prevented except those leading from said at least one of said plurality of heat exchangers; and third valve means provided in said hydrogen discharge pipes and operable so that the passage of hydrogen through the hydrogen discharge pipes is prevented except those leading to said at least one of the other heat exchange zones, whereby the hydrogen released from said at least one of said plurality of heat exchange zones is introduced into said gas turbine to drive same and is then reabsorbed by the hydrogen storage alloy in said at least one of the other heat exchange zones cooled by indirec heat exchange with the cooling medium.

7. An apparatus as claimed in claim 6, further comprising means disposed in said first and second hydrogen feed passages for heating the hydrogen from the first or second heat exchange zones before introduction into said gas turbine.

8. An apparatus for generating an electric energy, comprising:

a gas turbine having gas inlet and gas outlet ports and capable of being driven by hydrogen gas flowing from said inlet to outlet ports;

an electric generator operatively connected to said gas turbine and capable of operating, when said gas turbine is driven, to generate an electric energy;

first through sixth heat exchange zones each containing a hydrogen storage alloy capable of absorbing hydrogen upon being cooled and of releasing the absorbed hydrogen upon being heated and each adapted to heat or cool the hydrogen storage alloy containined therein by indirect heat exchange with a heating or cooling medium supplied thereto;

connecting conduit means connecting said first through sixth heat exchange zones in loop so that the heating or cooling medium can recirculate successively through said first to sixth heat exchange zones in that order;

a source of the heating medium;

a source of the cooling medium;

first through sixth, heating medium feed conduits, extending between said first through sixth heat exchange zones and said source of the heating medium, respectively, for introducing therethrough the heating medium to respective heat exchange zones;

first through sixth, cooling medium feed conduits, extending between said first through sixth heat exchange zones and said source of the cooling medium, respectively, for introducing therethrough the cooling medium to respective heat exchange zones;

first valve means provided in said heating medium and cooling medium feed conduits and operable so that the heating medium from said source thereof is fed to selected one of said first through sixth heat exchange zones and the cooling medium from said source thereof is fed to the next but two heat exchange zone located downstream of said selected heat exchange zone;

second valve means provided in said connecting conduit means and operable so that the heating medium introduced into said selected heat exchange zone is passed successively to two succeeding heat exchange zones located downstream from said selected heat exchange zone and the cooling medium introduced into said next but two heat exchange zone is passed successively to two succeeding heat exchange zones located downstream from said next but two heat exchange zone;

first through sixth hydrogen feed pipes, extending between said first through sixth heat exchange zones and said gas inlet, respectively, for introducing the released hydrogen from respective heat exchange zones into said gas turbine;

first through sixth hydrogen discharge pipes, extending between said first through sixth heat exchange zones and said gas outlet, respectively, for feeding the hydrogen from said gas turbine to respective heat exchange zones;

third valve means provided in said first through sixth hydrogen feed pipes and operable so that the passage of hydrogen through said first through sixth hydrogen feed pipes is prevented except those leading from said selected heat exchange zone and its adjacent downstream heat exchange zone; and fourth valve means provided in said first through sixth hydrogen discharge pipes and operable so that the passage of hydrogen through said first through sixth hydrogen discharge pipes is prevented except those leading to said next but two heat exchange zone and its adjacent downstream heat exchange zone.

9. An apparatus as claimed in claim 8, further comprising connecting pipe means for connecting said first through sixth heat exchange zones in parallel, and fifth valve means provided in said connecting pipe means and operable so that said selected heat exchange zone and said next but two heat exchange zone are in gas communication with each other.

10. An apparatus as claimed in claim 8, wherein said first through sixth heat exchange zones are each composed of one or more heat exchangers having heating or cooling medium inlet and outlet ports connected in series and hydrogen inlet and outlet ports connected in parallel with each other.

* * * * *